United States Patent [19]

Skomoroski

[11] 4,297,179

[45] Oct. 27, 1981

[54] PALLADIUM ELECTROPLATING BATH AND PROCESS

[75] Inventor: Robert M. Skomoroski, Paterson, N.J.

[73] Assignee: American Chemical & Refining Company Incorporated, Waterbury, Conn.

[21] Appl. No.: 183,318

[22] Filed: Sep. 2, 1980

[51] Int. Cl.[3] ..... C25D 3/52

[52] U.S. Cl. ..... 204/47; 204/43 N

[58] Field of Search ..... 204/47, 43 N, 109, 123

[56] References Cited

U.S. PATENT DOCUMENTS 3,925,170 12/1975 Skomoroski et al. ..... 204/43 N

*Primary Examiner*—G. L. Kaplan

[57] ABSTRACT

A cyanide-free bath for producing bright, adherent electrodeposits of palladium uses 3-butyne-2-ol as the brightener.

11 Claims, No Drawings

PALLADIUM ELECTROPLATING BATH AND PROCESS

BACKGROUND OF THE INVENTION

Numerous compositions have been proposed for the electrodeposition of palladium, and various electrolytes have been utilized to provide sufficient conductivity in such compositions. Cyanide baths for plating many of the noble metals have found considerable commercial application; however, there are of course pollution problems attendant to such baths, which have created an increasing trend toward the substitution of other electrolytes.

As is true with many of the noble metals, small amounts of brighteners may be employed in palladium baths to achieve optimum specular brightness in the eletrodeposit. Although highly effective and desirable from that standpoint, there is sometimes a tendency for the brightener itself to reduce the ductility of the deposit or to reduce its adhesion to the substrate.

A composition and method for producing bright electrodeposits of palladium, while avoiding the pollution problems associated with the use of a cyanide electrolyte, are described and claimed in Skomoroski et al. U.S. Pat. No. 3,925,170, entitled METHOD AND COMPOSITION FOR PRODUCING BRIGHT PALLADIUM ELECTRODEPOSITIONS, which issued on Dec. 9, 1975. While being entirely satisfactory in most respects, the composition of the aboveidentified patent utilizes cobalt, nickel or a mixture thereof as the brightening agent, and the presence of a metal in the bath may be undesirable in certain instances, such as when a deposit of utmost purity is to be produced. Thus, it is desirable to provide a palladium electroplating composition which need not contain any metallic brightener.

Accordingly, it is an object of the present invention to provide a novel composition for the electrodeposition of palladium in bright, highly adherent coatings upon various types of conductive substrates.

It is a more specific object to provide such a composition which need not contain any metallic brightener.

It is also an object to provide such composition which is operble over a wide range of current density and at ambient to low elevated temperatures.

Another object is to provide a novel method for the electroplating of palladium which is relatively trouble free and relatively insensitive to minor variations in operating conditions, and which will produce bright, highly adherent electrodeposits of palladium.

SUMMARY OF THE DISCLOSURE

It has now been found that certain of the foregoing and related objects of the present invention are readily attained in any alkaline aqueous bath for the electrodeposition of palladium, comprising about 0.035 to 0.4 gram mole per liter of palladium ion, at least about 1.5 gram moles per liter of ammonium radical, about $1.25\times10^{-5}$ to $125\times10^{-5}$ gram mole per liter of 3-butyne-2-ol as a brightener, and an effective amount of electrolyte, which bath has a pH of about 9 to 11.5. In the preferred baths, the amount of palladium ion is about 0.11 to 0.23 gram mole per liter, the amount of brightener is about $12.5\times10^{-5}$ to $25\times10^{-5}$ gram mole per liter, the pH is about 9.2 to 10.0, the specific gravity is 4° to 10° Baume, and the bath includes about 1.5 to 5.0 gram moles per liter of ammonium hydroxide.

The palladium ion is desirably provided in the bath as a compound selected from the group consisting of palladous nitrate, palladous chloride and mixtures thereof; most desirably it is provided as the mixture, with the amount of palladous nitrate being about 0.09 to 0.19 gram mole per liter and the amount of palladous chloride being about 0.02 to 0.04 gram mole per liter. In especially preferred embodiments, the electrolyte includes a compound selected from the group consisting of amino acids, sulfamic acid, ammonium sulfite, sodium sulfite and potassium sulfite; glycine, used at a concentration of about 0.5 to 2.5 gram moles per liter, is the preferred amino acid. It is especially desirable to include in the bath about $2.5\times10^{-5}$ to $60\times10^{-5}$ gram mole per liter of cetyltrimethylammonium bromide (CTAB), to minimize any tendency for pit formation in the deposit.

Other objects of the invention are readily attained in a method of electroplating palladium deposits upon a workpiece, comprising the steps of: immersing a workpiece having an electrically conductive surface in an aqueous alkaline bath of the foregoing composition; maintaining the temperature of the bath at about 25° to 60° Centigrade; applying an electrical potential across the workpiece and an anode to provide a current density of about 0.05 to 2.0 amperes per square decimeter at the workpiece, to effect the desired thickness for the electrodeposit; and removing the electroplated workpiece from the bath. In preferred embodiments of the method, the ratio of the surface areas of the anode to the workpiece is about 2 to 5:1, and the bath is agitated during electrodeposition. A current density of about 0.2 to 2.0 amperes per square decimeter will be especially desirable when the method is one of rack plating, whereas a value of about 0.05 to 0.5 ampere per square decimeter will normally be used for barrel plating operations.

DETAILED DESCRIPTON OF THE PREFERRED EMBODIMENTS

As has been indicated hereinbefore, the compositions of the present invention essentially comprise an aqueous solution of palladium ion, an electrolyte, a brightener comprised of 3-butyne-2-ol, and ammonium hydroxide sufficient to to provide a pH of about 9.0 to 11.5. Desirable optional additives include CTAB, and an electrical conductance improver, such as glycine.

Considering initially the source of palladium ion, introduction may be made as any soluble compound having a non-interfering anion, such as palladous sulfate, palladous chloride, palladous nitrate, or as a palladium complex such as diaminepalladium hydroxide, dichlorodiaminepalladium or tetraminepalladium chloride. However, the chloride and nitrate baths are preferred, and baths containing both species in combination are especially desirable. The amount of palladium in the bath may broadly range from 0.035 to 0.4 gram mole per liter, and is preferably within the range of 0.11 to 0.23 gram mole per liter. When the composition contains both compounds, the preferred amount of palladium nitrate is 0.09 to 0.19 gram mole per liter, and the preferred amount of the chloride is 0.02 to 0.04 gram mole per liter.

The electrolyte may be provided by any one or mixture of alkali metal and ammonium sulfates, sulfamates, phosphates, nitrates and nitrites. However, the preferred electrolytes are the amino acids, sulfamic acid, and ammonium, sodium and potassium sulfites; the amino acids, and in particular glycine, are found to be most advantageous in many baths. The electrolyte will, of course, be used in an effective concentration, which will generally mean that at least 0.1 gram mole per liter will be present. The preferred amount of electrolyte will be about 0.5 to 2.5 gram moles per liter, and the most desirable baths will typically contain 0.8 to 1.0 gram mole thereof.

Ammonium hydroxide is advantageously used to regulate the pH of the bath, and will generally be present in an amount of 1.5 to 5.0 gram moles per liter, calculated as ammonium hydroxide (exclusive of water). For the preferred compositions, the ammonium hydroxide is present in an amount of 2.5 to 3.5 gram moles per liter. Most desirably, the ammonium hydroxide is added as a highly concentrated aqueous solution (e.g., 29 percent by weight) in order to minimize dilution, although less concentrated compositions may also be employed if the water introduced thereby is entered into the calculations as to concentration of the remaining ions.

In the event that it is desired to adjust the pH downwardly (i.e., to make it more acid), an acid having non-interfering anion should be employed. Most conveniently and desirably, nitric acid, hydrochloric acid or a mixture thereof will be used, although sulfuric acid, sulfamic acid, and the like may be employed to advantage in appropriate cases.

As has been indicated heretofore, the brightener employed in the present compositions is 3-butyne-2-ol, used in amounts of about $1.25\times10^{-5}$ to $125\times10^{-5}$, and preferably about $12.5\times10^{-5}$ to $25\times10^{-5}$, gram mole per liter. While it is a primary advantage of the invention that the 3-butyne-2-ol produces brightness in the deposits without the need for metallic brighteners that would codeposit with the palladium, and thereby reduce purity, it is to be understood that the bath may include ions of metals other than palladium, if so desired.

Cetyltrimethylammonium bromide is an optional but desirable additive to effectively eliminate any tendency for gas pitting in the palladium deposit. The amount of this additive should be closely controlled since excessive amounts will produce undue foaming, and will thereby interfere with the plating operations. As a result, the maximum amount of CTAB that should be employed is about $60\times10^{-5}$ gram mole (or 0.2 gram) per liter; preferably, the maximum concentration is less than $16\times10^{-5}$ gram mole per liter. An amount of as little as $2.5\times10^{-5}$ gram mole per liter and preferably $8\times10^{-5}$ gram mole per liter (about 0.01 and 0.03 gram per liter respectively), will usually produce highly advantageous results.

The pH of the bath is maintained within the range of 9.0 to 11.5, and preferably within the range of 9.2 to 10.0. As indicated hereinbefore, the pH may be adjusted as necessary, typically by the addition of ammonium hydroxide or by the use of a suitable acid providing a non-interfering anion, such as nitric and/or hydrochloric acids.

The temperature of the bath should be within the range of 25° to 60° Centigrade, and preferably 45° to 55°. Generally, the density of the bath will be about 4° to 20°, and more commonly 5° to 15°, Baume. Although the bath may be utilized without agitation, it is most desirable to employ stirring or electrode movement. Filtration significantly promotes the production of pore-free adherent deposits, because of the profound effect that the presence of any solid contaminants can have, and is therefore a highly desirable practice. Standard filter cartridges of polypropylene or other filter media may advantageously be employed for continuous filtration.

The anode to cathode surface area ratio should be within the range of 1.0 to 5.0:1.0, and preferably a ratio of about 2.0:1.0 will be used. For rack plating, the current density will typically be within the range of 0.2 to 2.0 amperes per square decimeter, and preferably about 0.5 to 1.0 ampere per square decimeter. For barrel plating, the current density should be within the range of 0.05 to 0.5 ampere per square decimeter, with the preferred maximum value being about 0.3 ampere per square decimeter.

Various anodes that are inert to the plating bath may be employed, and will generally have a surface of noble metal, although carbon anodes do have limmited utility. The preferred anodes are of platinum-clad tantalum, but gold-clad tantalum, platinum and palladium electrodes may all be employed effectively.

Exemplary of the efficacy of the baths and methods of the present invention are the following specific examples:

EXAMPLE ONE

A palladium electroplating bath is prepared by dissolving 8 grams of palladium metal powder in a mixture of 12 milliliters of concentrated nitric acid, 4 milliliters of concentrated hydrochloric acid and 20 milliliters of deionized water; the mixture is heated gently to obtain complete dissolution of the metal. To the foregoing is added 33.4 grams of glycine and 65 milliliters of ammonium hydroxide dissolved in 100 milliliters of deionized water, following which the resultant solution is filtered to remove the small amount of insoluble material that appears. More water is added to increase the volume to 500 milliliters, and 10 milliliters of a 0.1 percent solution of 3-butyne-2-ol in deionized water (i.e., a solution of one milliliter per liter of water) is introduced; the resulting bath is found to have a density of about 6.3° Baume and a pH of about 9.5 to 10. Using as the cathode a 3 cm×5 cm brass "coupon" plated with a thin gold strike, and as the anode a platinum-surfaced electrode of such a size as to provide an anode:cathode surface area ratio of about 2:1, plating is effected under the various conditions set forth in Table One below. The pH of the bath is maintained in the indicated range of values by additions of ammonium hydroxide, as necessary, and in some instances (as indicated by an "X") cetyltrimethylammonium bromide is incorporated into the bath by adding 0.3 milliliter of an aqueous solution containing 125 grams per liter thereof. In all instances, bright deposits of palladium are produced, with those obtained from the baths containing CTAB being especially free from pitting; repeated flexing of the panels demonstrates that the deposits are highly adherent.

TABLE ONE

| Current | Potential | Time | Temperature | CTAB |
|---|---|---|---|---|
| 150 | 1.4 | 15 | 54 | — |
| 150 | 1.4 | 15 | 60 | — |
| 150 | 1.4 | 30 | 60 | — |
| 150 | 1.4 | 60 | 60 | — |
| 150 | 1.5 | 15 | 60 | X |
| 150 | 1.5 | 30 | 60 | X |
| 150 | 1.5 | 60 | 60 | X |

TABLE ONE-continued

| Current | Potential | Time | Temperature | CTAB |
|---|---|---|---|---|
| 150 | 1.6 | 15 | 38 | X |
| 150 | 1.6 | 15 | 43 | X |
| 300 | 1.6 | 15 | 60 | — |
| 300 | 1.7 | 15 | 60 | — |
| 150 | 1.8 | 15 | 54 | X |

In the foregoing Table, the current is expressed in milliamperes, the applied potential is in volts, the time is in minutes and the temperature is in degrees C.

EXAMPLE TWO

A bath comparable to that of Example One, including the same concentration of 3-butyne-2-ol but containing about 75 grams per liter of glycine and about 16.4 grams per liter of palladium (as the metal), is used at a pH of 9.2 and a temperature of 54° C. to electroplate nickel pins. The pins, which have their surfaces covered by a gold strike over a copper strike and which present a total surface area of about 363 square centimeters, are electroplated in a 2-inch×4-inch plating barrel for a period of 80 minutes; the voltage and current applied are 1.7 volts and 250 milliamperes, respectively, providing a nominal current density of about 0.075 ampere per square decimeter. A semibright, adherent deposit of good quality is produced. Utilizing the same bath to barrel plate a quantity of pins sufficient to provide a total surface area of 1,085 square centimeters, with an applied current of 900 milliamperes for a period of 122 minutes, produces a deposit of comparable quality with a cathode efficiency of about 83 percent. In each of the foregoing instances, plating is effected to produce a deposit of 100 microinches; however, it will, of course, be appreciated that the thickness of the electroplate will vary among individual pins, as well as on different portions of each of them.

Thus, it can be seen that the present invention provides a novel composition for the electrodeposition of palladium in bright, highly adherent coatings upon various types of conductive substrates without need for any metallic brightener, which composition is operable over a wide range of current density and at ambient to low elevated temperatures. The invention also provides a novel method for the electroplating of palladium, which is relatively trouble free and relatively insensitive to minor variations in operating conditions, and which will produce bright, highly adherent electrodeposits of palladium.

Having thus described the invention, what is claimed is:

1. An aqueous alkaline bath for the electrodeposition of palladium, comprising:

(a) about 0.035 to 0.4 gram mole per liter of palladium ion;

(b) at least about 1.5 gram moles per liter of ammonium radical;

(c) about $1.25\times10^{-5}$ to $125\times10^{-5}$ gram mole per liter of 3-butyne-2-ol as a brightener; and (d) at least 0.1 gram mole of electrolyte per liter;

said bath having a pH of about 9 to 11.5, and being free of cyanide radical.

2. The bath of claim 1 wherein the amount of palladium ion is about 0.11 to 0.23 gram mole per liter, the amount of said brightener is about $12.5\times10^{-5}$ to $25\times10^{-5}$ gram mole per liter, said pH is about 9.2 to 10.0, and wherein about 1.5 to 5.0 gram moles per liter of ammonium hydroxide is included.

3. The bath of claim 2 wherein said palladium ion is provided in said bath as compound selected from the group consisting of palladous nitrate, palladous chloride, and mixtures thereof.

4. The bath of claim 3 wherein sid palladium ion is provided as said mixture, the amount of palladous nitrate being about 0.09 to 0.19 gram mole per liter and the amount of palladous chloride being about 0.02 to 0.04 gram mole per liter.

5. The bath of claim 1 wherein said electrolyte includes a compound selected from the group consisting of amino acids, sulfamic acid, ammonium sulfite, sodium sulfite and potassium sulfite.

6. The bath of claim 5 wherein the compound of said group is glycine, and is present in said bath in a concentration of about 0.5 to 2.5 gram moles per liter.

7. The bath of claim 1 additionally including about $2.5\times10^{-5}$ to $60\times10^{-5}$ gram mole per liter of cetyltrimethylammonium bromide.

8. In a method of electroplating palladium deposits upon a workpiece, the steps comprising:

a. immersing a workpiece having an electrically conductive surface in the aqueous alkaline bath of claim 1;

b. maintaining the temperature of said bath at about 25° to 60° C.;

c. applying an electrical potential across said workpiece and an anode to provide a current density of about 0.05 to 2.0 amperes per square decimeter at said workpiece, to effect plating of the desired thickness for the electrodeposit; and d. removing the electroplated workpiece from said bath.

9. The method of claim 8 wherein the ratio of the surface areas of the anode to said workpiece is about 2 to 5:1, and wherein said bath is agitated during electrodeposition.

10. The method of claim 9 wherein said current density at said workpiece is about 0.2 to 2.0 amperes per square decimeter, and wherein said method utilizes a rack plating technique.

11. The method of claim 9 wherein said current density is about 0.5 to 0.5 ampere per square decimeter, and wherein said method utilizes a barrel plating technique.

* * * * *

UNITED STATES PATENT AND TRADEMARK OFFICE

CERTIFICATE OF CORRECTION

PATENT NO. : 4,297,179

DATED : October 27, 1981

INVENTOR(S) : ROBERT M. SKOMOROSKI

It is certified that error appears in the above-identified patent and that said Letters Patent are hereby corrected as shown below:

Column 6, line 56, "0.5 to 0.5" should be -- 0.05 to 0.5 --

Signed and Sealed this

*Twenty-third* Day of *March 1982*

[SEAL]

*Attest:*

GERALD J. MOSSINGHOFF

*Attesting Officer*

*Commissioner of Patents and Trademarks*